US011085439B2

(12) United States Patent
Pawlick

(10) Patent No.: US 11,085,439 B2
(45) Date of Patent: Aug. 10, 2021

(54) HEAT EXCHANGER ASSEMBLY WITH HEAT SHIELDING DUCT

(71) Applicant: COPPER CORE LIMITED, Toronto (CA)

(72) Inventor: Daniel R. Pawlick, Toronto (CA)

(73) Assignee: Copper Core Limited, Toronto (CA)

( * ) Notice: Subject to any disclaimer, the term of this patent is extended or adjusted under 35 U.S.C. 154(b) by 251 days.

(21) Appl. No.: 16/170,191

(22) Filed: Oct. 25, 2018

(65) Prior Publication Data

US 2019/0390667 A1 Dec. 26, 2019

(30) Foreign Application Priority Data

Jun. 26, 2018 (CA) ..... 3009337

(51) Int. Cl.

| | |
|---|---|
| ***F04B 53/08*** | (2006.01) |
| ***F01P 3/18*** | (2006.01) |
| ***F04B 17/05*** | (2006.01) |
| ***F04B 17/06*** | (2006.01) |
| *E21B 43/26* | (2006.01) |

(52) U.S. Cl.

CPC ..... *F04B 53/08* (2013.01); *F01P 3/18* (2013.01); *F04B 17/05* (2013.01); *F04B 17/06* (2013.01); *E21B 43/26* (2013.01); *F01P 2003/182* (2013.01); *F01P 2003/185* (2013.01)

(58) Field of Classification Search

CPC ..... F04B 53/08; F04B 17/05; F04B 17/06; F04B 47/00; F04B 53/22; F01P 3/18; F01P 2003/185; F01P 2003/182; E21B 43/26

See application file for complete search history.

(56) References Cited

U.S. PATENT DOCUMENTS

| | | | | |
|---|---|---|---|---|
| 3,043,390 A * | 7/1962 | Lattay | ..... | B60K 11/08 180/68.1 |
| 3,363,885 A | 1/1968 | Meek | | |
| 3,384,165 A | 5/1968 | Matthews | | |
| 4,757,858 A | 7/1988 | Miller | | |

(Continued)

FOREIGN PATENT DOCUMENTS

| | | |
|---|---|---|
| CA | 2963568 | 10/2017 |
| CA | 2963572 | 10/2017 |

*Primary Examiner* — Peter J Bertheaud
*Assistant Examiner* — Dnyanesh G Kasture
(74) *Attorney, Agent, or Firm* — Thorpe North and Western LLP

(57) ABSTRACT

A mobile pump unit including a mobile trailer having mounted thereon one or more pumps, an internal combustion engine(s) to power the one or more pumps, and a heat exchanger assembly for cooling a fluid for the engine, transmission, hydraulic driven components, or pressure pump. The heat exchanger assembly includes a heat exchanger with an air inlet. The air inlet faces the engine and is for receiving air. In addition to the air inlet, the heat exchanger has a fluid inlet for receiving the fluid; a heat exchange surface for transferring heat from the fluid to the air; an air outlet for discharging the air; and a fluid outlet for delivering the fluid to the engine. The heat exchanger assembly also includes an air circulation device for moving the air through the heat exchanger, and an air intake duct that directs the air into the air inlet of the heat exchanger. The air intake duct is configured to resist heated air produced by the engine from entering the air inlet.

14 Claims, 11 Drawing Sheets

(56) References Cited

U.S. PATENT DOCUMENTS

| | | | | |
|---|---|---|---|---|
| 4,788,013 | A | 11/1988 | Kinney | |
| 5,538,079 | A | 7/1996 | Pawlick | |
| 5,715,889 | A | 2/1998 | Peterson | |
| 9,109,594 | B2 | 8/2015 | Pawlick | |
| 9,335,098 | B2 | 5/2016 | Pawlick | |
| 9,945,578 | B2 | 4/2018 | Vanberg et al. | |
| 9,970,720 | B2 | 5/2018 | Vanberg et al. | |
| 2011/0063778 | A1 | 3/2011 | Brouillard | |
| 2011/0272120 | A1 | 11/2011 | Joshi | |
| 2015/0122455 | A1 | 5/2015 | Fox | |
| 2017/0284751 | A1 | 10/2017 | Noyes | |
| 2017/0292735 | A1 | 10/2017 | Hjorth et al. | |
| 2017/0292736 | A1 | 10/2017 | Hjorth et al. | |
| 2017/0292789 | A1 | 10/2017 | Hjorth et al. | |
| 2017/0292800 | A1 | 10/2017 | Vanberg et al. | |
| 2017/0292801 | A1 | 10/2017 | Vanberg et al. | |
| 2017/0294103 | A1 | 10/2017 | Vanberg et al. | |
| 2017/0294366 | A1 | 10/2017 | Vanberg et al. | |
| 2018/0003532 | A1 | 1/2018 | Vanberg et al. | |
| 2018/0209752 | A1 | 7/2018 | Vanberg et al. | |
| 2018/0257482 | A1* | 9/2018 | Kondo | B60K 1/04 |
| 2019/0017747 | A1* | 1/2019 | Sakaray | F02B 63/04 |
| 2019/0178590 | A1* | 6/2019 | Vanberg | E21B 43/26 |

* cited by examiner

HEAT EXCHANGER ASSEMBLY WITH HEAT SHIELDING DUCT

FIELD OF THE INVENTION

This invention relates to heat exchangers, and more particularly to heat exchanger assemblies for cooling internal combustion engines, such as those used to power mobile hydraulic fracturing pumps.

BACKGROUND OF THE INVENTION

Hydraulic fracturing is a known process which requires heavy duty pumps driven by internal combustion engines, typically diesel motors. The large horsepower required to drive each pump produces significant amounts of heat, which must be rapidly dissipated from the engine to avoid overheating. A radiator or heat exchanger assembly is typically used to cool the engine, for example by receiving a heated fluid from the engine, such as a liquid coolant or transmission oil, and transferring the heat into the surrounding air before returning the fluid to the engine. The heat exchanger assembly and the engine are typically mounted near one another on a mobile trailer to allow for easy transport to fracturing sites, as well as the direct exchange of internal fluids between the engine and the heat exchanger assembly. The proximity of the heat exchanger assembly to the engine can, however, limit its cooling capacity. For example, if hot air produced by the engine is drawn into the heat exchanger assembly, then the air will be less effective at removing heat from the fluid. If the heat exchangers are positioned away from the engine to avoid drawing in the hot air, then the internal fluids will have to travel a greater distance between the engine and the heat exchangers, leading to a disadvantageous drop in fluid pressure. Furthermore, as there is limited space available for heat exchange on the mobile trailer, having no heat exchanger in the space closest to the engine limits the cooling capacity of the assembly.

SUMMARY OF THE INVENTION

To at least partially overcome some of the disadvantages of previously known products and methods, the invention provides a heat exchanger assembly including a heat exchanger that faces a heat producing device, such as an engine, and an air intake duct that resists heated air produced by the heat producing device from entering the heat exchanger. The inventors have appreciated that the heat exchanger assembly can maximize the space available for heat exchange equipment on a mobile trailer, by making use of the space closest to the heat producing device, while maintaining a high cooling capacity and an efficient exchange of fluids.

A heat exchanger of the present invention that faces the heat producing device is able to efficiently exchange fluids with the heat producing device, in light of the minimal distance therebetween. The heat exchanger of the present invention is thus well suited to cooling fluids that need to be delivered rapidly to the heat producing device, such as compressed air for a turbocharger. The air intake duct furthermore prevents heated air produced by the heat producing device from entering the heat exchanger, thus maintaining a high cooling capacity. The air intake duct may, for example, draw cooling air from a side of the assembly that faces away from the heat producing device. The air intake duct may include a duct wall that is interposed between the heat exchanger and the heat producing device, thus preventing the heat exchanger from drawing heated air from the area surrounding the heat producing device. The assembly may include additional heat exchangers that, for example, face away from the heat producing device, and which may be used to cool additional fluids such as transmission oil or a liquid coolant.

In some embodiments, the assembly has a generally cubic or box-like shape, and includes a fan that draws air through the heat exchangers into an internal air chamber before expelling the air upwardly. Optionally, the assembly is configured to be positioned adjacent to a second heat exchanger assembly, which cools a fluid for a second heat producing device. The air intake duct is preferably configured to prevent the heated air produced by both heat producing devices from entering the heat exchanger.

Further aspects of the invention include:

1. A mobile pump unit comprising:

a mobile trailer having mounted thereon one or more pumps, an internal combustion engine to power the one or more pumps, and a heat exchanger assembly for cooling a fluid;

the heat exchanger assembly comprising:

a heat exchanger having an air inlet that faces the engine, the heat exchanger comprising:

the air inlet for receiving air;

a fluid inlet for receiving the fluid;

a heat exchange surface for transferring heat from the fluid to the air;

an air outlet for discharging the air; and a fluid outlet for discharging the fluid;

the heat exchanger assembly further comprising:

an air circulation device for moving the air through the heat exchanger; and an air intake duct that directs the air into the air inlet of the heat exchanger, the air intake duct being configured to resist heated air produced by the engine from entering the air inlet.

2. A mobile pump unit, optionally including one or more features of 1, wherein the air intake duct is configured to draw the air laterally from a side of the heat exchanger assembly.

3. A mobile pump unit, optionally including one or more features of 1 or 2, wherein the air intake duct has an inlet opening that faces away from the engine.

4. A mobile pump unit, optionally including one or more features of 1 to 3, wherein the inlet opening opens laterally of the air inlet.

5. A mobile pump unit, optionally including one or more features of 1 to 4, wherein the air intake duct defines an air passageway that extends from the inlet opening to the air inlet; and wherein the air intake duct has a duct wall that is interposed between the air passageway and the engine.

6. A mobile pump unit, optionally including one or more features of 1 to 5, wherein the inlet opening is a first inlet opening that is configured to draw the air laterally from a first side of the heat exchanger assembly, the air intake duct having a second inlet opening that is configured to draw the air laterally from a second side of the heat exchanger assembly.

7. A mobile pump unit, optionally including one or more features of 1 to 6, wherein the duct wall has a first segment and a second segment, the first segment extending from a central portion of the air inlet to the first inlet opening, the second segment extending from the central portion of the air inlet to the second inlet opening;

wherein the first segment is angled outwardly from the air inlet as the first segment extends from the central portion to the first inlet opening; and wherein the second segment is angled outwardly from the air inlet as the second segment extends from the central portion to the second inlet opening.

8. A mobile pump unit, optionally including one or more features of 1 to 7, wherein the air intake duct comprises:

a top wall that prevents the air from entering the air intake duct directly from above; and a bottom wall that prevents the air from entering the air intake duct directly from below.

9. A mobile pump unit, optionally including one or more features of 1 to 8, wherein the air intake duct comprises a heat shielding surface that is configured to prevent the engine from heating the air within the air intake duct.

10. A mobile pump unit, optionally including one or more features of 1 to 9, wherein the heat shielding surface is configured to prevent the engine from heating the air within the air intake duct by conduction.

11. A mobile pump unit, optionally including one or more features of 1 to 10, wherein the heat shielding surface is configured to prevent the engine from heating the air within the air intake duct by convection.

12. A mobile pump unit, optionally including one or more features of 1 to 11, wherein the heat shielding surface is configured to prevent the engine from heating the air within the air intake duct by thermal radiation.

13. A mobile pump unit, optionally including one or more features of 1 to 12, wherein the air intake duct is removable.

14. A mobile pump unit, optionally including one or more features of 1 to 13, wherein the heat exchanger has a generally rectangular or square body with an outwardly facing side and an inwardly facing side;

wherein the outwardly facing side comprises the air inlet; and wherein the inwardly facing side comprises the air outlet.

15. A mobile pump unit, optionally including one or more features of 1 to 14, wherein the heat exchanger body defines a plurality of air channels that extend from the outwardly facing side to the inwardly facing side and pass through or adjacent to the heat exchange surface.

16. A mobile pump unit, optionally including one or more features of 1 to 15, wherein the air intake duct is interposed between the engine and the outwardly facing side of the heat exchanger body.

17. A mobile pump unit, optionally including one or more features of 1 to 16, wherein the outwardly facing side of the heat exchanger body is angled, relative to a line extending from the heat exchanger body to the engine, more than 0 degrees and less than 180 degrees.

18. A mobile pump unit, optionally including one or more features of 1 to 17, wherein the outwardly facing side of the heat exchanger body is angled, relative to the line extending from the heat exchanger body to the engine, more than 30 degrees and less than 150 degrees.

19. A mobile pump unit, optionally including one or more features of 1 to 18, wherein the outwardly facing side of the heat exchanger body is angled, relative to the line extending from the heat exchanger body to the engine, more than 45 degrees and less than 135 degrees.

20. A mobile pump unit, optionally including one or more features of 1 to 19, wherein the outwardly facing side of the heat exchanger body is angled, relative to the line extending from the heat exchanger body to the engine, more than 60 degrees and less than 120 degrees.

21. A mobile pump unit, optionally including one or more features of 1 to 20, wherein the outwardly facing side of the heat exchanger body is angled, relative to the line extending from the heat exchanger body to the engine, about 90 degrees.

22. A mobile pump unit, optionally including one or more features of 1 to 21, wherein the heat exchanger further comprises a plurality of tubes for carrying the fluid and a plurality of cooling fins in contact with the plurality of tubes, wherein the heat exchange surface comprises at least one of: a surface of the plurality of tubes and a surface of the plurality of cooling fins.

23. A mobile pump unit, optionally including one or more features of 1 to 22, further comprising a frame for mounting the heat exchanger, the air circulation device, and the air intake duct, wherein the heat exchanger is removable from the frame.

24. A mobile pump unit, optionally including one or more features of 1 to 23, wherein the air circulation device comprises a fan.

25. A mobile pump unit, optionally including one or more features of 1 to 24, wherein the fan is hydraulically driven.

26. A mobile pump unit, optionally including one or more features of 1 to 25, wherein the fan is configured to draw the air through the heat exchanger and then expel the air away from the heat exchanger.

27. A mobile pump unit, optionally including one or more features of 1 to 26, wherein the fan is configured to expel the air upwardly.

28. A mobile pump unit, optionally including one or more features of 1 to 27, wherein the fan faces upwardly and is positioned behind and above the heat exchanger.

29. A mobile pump unit, optionally including one or more features of 1 to 28, wherein the heat exchanger assembly defines an internal air flow chamber that is open to the air outlet, the fan being configured to produce an air flow that draws the air through the heat exchanger and into the internal air flow chamber, and then expels the air upwardly from the heat exchanger assembly.

30. A mobile pump unit, optionally including one or more features of 1 to 29, wherein the heat exchanger is a first heat exchanger, the heat exchanger assembly further comprising a second heat exchanger.

31. A mobile pump unit, optionally including one or more features of 1 to 30, wherein the second heat exchanger faces away from the engine.

32. A mobile pump unit, optionally including one or more features of 1 to 31, further comprising a third heat exchanger and a fourth heat exchanger.

33. A mobile pump unit, optionally including one or more features of 1 to 32, wherein the air circulation device is configured to draw air through the second heat exchanger, the third heat exchanger, and the fourth heat exchanger;

wherein the second heat exchanger is configured to receive the air from a right side of the heat exchanger assembly;

wherein the third heat exchanger is configured to receive the air from a rear side of the heat exchanger assembly; and wherein the fourth heat exchanger is configured to receive the air from a left side of the heat exchanger assembly.

34. A mobile pump unit, optionally including one or more features of 1 to 33, wherein the first heat exchanger is positioned on a front side of the heat exchanger assembly that faces the engine;

wherein the second heat exchanger is positioned on the right side of the heat exchanger assembly, which faces laterally away from the engine;

wherein the third heat exchanger is positioned on the rear side of the heat exchanger assembly, which faces rearwardly away from the engine; and wherein the fourth heat exchanger is positioned on the left side of the heat exchanger assembly, which faces laterally away from the engine.

35. A mobile pump unit, optionally including one or more features of 1 to 34, wherein the fluid is a first fluid, and the second heat exchanger is configured to cool the first fluid or a second fluid.

36. A mobile pump unit, optionally including one or more features of 1 to 35, wherein the one or more pumps comprises a hydraulic fracturing pump.

37. A mobile pump unit, optionally including one or more features of 1 to 36, wherein the fluid is compressed air, transmission oil, hydraulic oil, gear oil, diesel fuel, or a liquid coolant.

38. A mobile pump unit, optionally including one or more features of 1 to 37, wherein the heat exchanger assembly has a generally cubic or box-like shape.

39. A mobile pump unit, optionally including one or more features of 1 to 38, wherein the air intake duct has a rearwardly angled intake opening.

40. A mobile pump unit, optionally including one or more features of 1 to 39, wherein the intake opening is angled more than 90 degrees from the air inlet.

41. A mobile pump unit, optionally including one or more features of 1 to 40, wherein the intake opening is angled more than 135 degrees from the air inlet.

42. A mobile pump unit, optionally including one or more features of 1 to 41, wherein the intake opening is angled about 180 degrees from the air inlet.

43. A mobile pump unit, optionally including one or more features of 1 to 42, wherein the air intake duct extends laterally from the heat exchanger, with the intake opening configured to draw the air from rearwardly of the heat exchanger.

44. A mobile pump unit, optionally including one or more features of 1 to 43, wherein the air intake duct comprises a side wall that is at least partially positioned laterally of the air inlet and that is angled rearwardly relative to the air inlet.

45. A mobile pump unit, optionally including one or more features of 1 to 44, wherein the side wall is configured to prevent the intake opening from drawing the air from forwardly of the heat exchanger assembly.

46. A mobile pump unit, optionally including one or more features of 1 to 45, wherein the side wall is interposed between the intake opening and a second engine.

47. A mobile pump unit, optionally including one or more features of 1 to 46, wherein the side wall is configured to resist heated air produced by the second engine from entering the air inlet.

48. A mobile pump unit, optionally including one or more features of 1 to 47, comprising:

a mobile trailer having mounted thereon one or more pumps, a first internal combustion engine to power the one or more pumps, a second internal combustion engine to power the one or more pumps, a first heat exchanger assembly for cooling a first fluid, and a second heat exchanger assembly for cooling a second fluid;

the first heat exchanger assembly comprising a first heat exchanger having a first air inlet that faces the first engine, the first heat exchanger comprising:

the first air inlet for receiving air;

a first fluid inlet for receiving the first fluid;

a first heat exchange surface for transferring heat from the first fluid to the air;

a first air outlet for discharging the air; and a first fluid outlet for discharging the first fluid;

the first heat exchanger assembly further comprising:

a first air circulation unit for moving the air through the first heat exchanger; and a first air intake duct that directs the air into the first air inlet, the first air intake duct being configured to resist heated air produced by the first engine and the second engine from entering the first air inlet;

the second heat exchanger assembly comprising a second heat exchanger having a second air inlet that faces the second engine, the second heat exchanger comprising:

the second air inlet for receiving air;

a second fluid inlet for receiving the second fluid;

a second heat exchange surface for transferring heat from the second fluid to the air;

a second air outlet for discharging the air; and a second fluid outlet for discharging the second fluid;

the second heat exchanger assembly further comprising:

a second air circulation unit for moving the air through the second heat exchanger; and a second air intake duct that directs the air into the second air inlet, the second air intake duct being configured to resist the heated air produced by the first engine and the second engine from entering the second air inlet.

49. A mobile pump unit, optionally including one or more features of 1 to 48, wherein the first heat exchanger assembly is mounted adjacent to the second heat exchanger assembly, with a walkway provided therebetween; and wherein the first engine is mounted adjacent to the second engine, with the first engine positioned diagonally forward of the second air inlet, and the second engine positioned diagonally forward of the first air inlet.

50. A mobile pump unit, optionally including one or more features of 1 to 49, wherein the first air intake duct and the second air intake duct are configured to draw the air from the walkway.

51. A mobile pump unit, optionally including one or more features of 1 to 50, wherein the first air intake duct has a first intake opening that faces away from the first engine and the second engine; and wherein the second air intake duct has a second intake opening that faces away from the first engine and the second engine.

52. A mobile pump unit, optionally including one or more features of 1 to 51, wherein the first air intake duct defines a first air passageway that extends from the first intake opening to the first air inlet;

wherein the first air intake duct has a first duct wall that is interposed between the first air passageway and the first engine, and between the first air passageway and the second engine;

wherein the second air intake duct defines a second air passageway that extends from the second intake opening to the second air inlet; and wherein the second air intake duct has a second duct wall that is interposed between the second air passageway and the first engine, and between the second air passageway and the second engine.

53. A mobile pump unit, optionally including one or more features of 1 to 52, wherein the first air intake opening is angled rearwardly, and the second air intake opening is angled rearwardly.

54. A mobile pump unit, optionally including one or more features of 1 to 53, wherein the first air intake duct extends laterally from the first heat exchanger towards the walkway, with the first intake opening configured to draw the air from the walkway rearwardly of the first heat exchanger; and wherein the second air intake duct extends laterally from the second heat exchanger towards the walkway, with the second intake opening configured to draw the air from the walkway rearwardly of the second heat exchanger.

55. A mobile pump unit, optionally including one or more features of 1 to 54, wherein the first air intake duct comprises a first side wall that is at least partially positioned laterally of the first air inlet and is angled rearwardly relative to the first air inlet; and wherein the second air intake duct comprises a second side wall that is at least partially positioned laterally of the second air inlet and is angled rearwardly relative to the second air inlet.

56. A mobile pump unit, optionally including one or more features of 1 to 55, wherein the first side wall is configured to prevent the first intake opening from drawing the air from forwardly of the first heat exchanger assembly; and wherein the second side wall is configured to prevent the second intake opening from drawing the air from forwardly of the second heat exchanger assembly.

57. A mobile pump unit, optionally including one or more features of 1 to 56, wherein the first heat exchanger assembly further comprises:

a first side heat exchanger that is positioned on a side of the first heat exchanger assembly opposite from the walkway; and a first rear heat exchanger that is positioned on a rear side of the first heat exchanger assembly;

wherein the second heat exchanger assembly further comprises:

a second side heat exchanger that is positioned on a side of the second heat exchanger assembly opposite from the walkway; and a second rear heat exchanger that is positioned on a rear side of the second heat exchanger assembly.

58. A mobile pump unit, optionally including one or more features of 1 to 57, wherein the first heat exchanger assembly and the second heat exchanger assembly each have a generally cubic or box-like shape.

59. A method of cooling a fluid, optionally including one or more features of 1 to 58, the method comprising:

mounting a heat exchanger to a mobile trailer, the heat exchanger having an air inlet that faces an engine;

providing an air intake duct that directs air into the air inlet of the heat exchanger;

positioning the air intake duct relative to the heat exchanger and the engine to resist heated air produced by the engine from entering the air inlet;

circulating the fluid past a heat exchange surface of the heat exchanger;

drawing the air into the air inlet; and circulating the air past the heat exchange surface so that heat from the fluid is transferred to the air.

60. A method of cooling a fluid for an engine mounted to a mobile trailer, optionally including one or more features of 1 to 59, wherein drawing the air into the air inlet comprises drawing the air from laterally of the air inlet.

61. A method of cooling a fluid for an engine mounted to a mobile trailer, optionally including one or more features of 1 to 60, wherein drawing the air into the air inlet comprises drawing the air from rearwardly of the air inlet.

62. A method of cooling a fluid for an engine mounted to a mobile trailer, optionally including one or more features of 1 to 61, wherein positioning the air intake duct comprises positioning a side wall of the air intake duct so that the air inlet is prevented from drawing the air from forwardly of the air inlet.

63. A method of cooling a fluid for an engine mounted to a mobile trailer, optionally including one or more features of 1 to 62, further comprising providing a heat shielding surface interposed between the air inlet and the engine.

64. A method of cooling a fluid for an engine mounted to a mobile trailer, optionally including one or more features of 1 to 63, further comprising expelling the air upwardly relative to the heat exchanger.

65. A method of cooling a fluid for an engine mounted to a mobile trailer, optionally including one or more features of 1 to 64, wherein positioning the air intake duct comprises interposing a duct wall between the air inlet and the engine.

66. A method of cooling a fluid for an engine mounted to a mobile trailer, optionally including one or more features of 1 to 65, wherein positioning the air intake duct further comprises interposing the duct wall between the air inlet and a second engine.

67. A method of cooling a fluid for an engine mounted to a mobile trailer, optionally including one or more features of 1 to 66, further comprising:

providing a heat exchanger assembly incorporating the heat exchanger and one or more additional heat exchangers; and positioning the additional heat exchangers to face away from the engine.

68. A heat exchanger assembly for cooling a fluid for a heat producing device, optionally including one or more features of 1 to 67, the heat exchanger assembly comprising:

a heat exchanger having an air inlet that faces the heat producing device, the heat exchanger comprising:

the air inlet for receiving air;

a fluid inlet for receiving the fluid;

a heat exchange surface for transferring heat from the fluid to the air;

an air outlet for discharging the air; and a fluid outlet for delivering the fluid to the heat producing device;

the heat exchanger assembly further comprising:

an air circulation device for moving the air through the heat exchanger; and an air intake duct that directs the air into the air inlet of the heat exchanger, the air intake duct being configured to prevent heated air produced by the engine from entering the air inlet.

69. A method of cooling a fluid for a heat producing device, optionally including one or more features of 1 to 68, the method comprising:

providing a heat exchanger having an air inlet that faces the heat producing device;

providing an air intake duct that directs air into the air inlet of the heat exchanger;

positioning the air intake duct relative to the heat exchanger and the heat producing device so that heated air produced by the heat producing device is prevented from entering the air inlet;

circulating the fluid past a heat exchange surface of the heat exchanger;

drawing the air into the air inlet; and circulating the air past the heat exchange surface so that heat from the fluid is transferred to the air.

70. A mobile pump unit, optionally including one or more features of 1 to 69, wherein the fluid outlet is configured to deliver the fluid to the engine or to another heat generating component.

71. A mobile pump unit, optionally including one or more features of 1 to 70, wherein the first fluid outlet is configured to deliver the first fluid to the first engine, the second engine, a first additional heat generating component, or a second additional heat generating component; and wherein the second fluid outlet is configured to deliver the second fluid to the first engine, the second engine, the first additional heat generating component, or the second additional heat generating component.

72. A method, optionally including one or more features of 1 to 71, further comprising delivering the fluid to the engine or to another heat generating component.

BRIEF DESCRIPTION OF THE DRAWINGS

Further aspects and advantages of the invention will appear from the following description taken together with the accompanying drawings, in which.

DETAILED DESCRIPTION OF THE DRAWINGS

Figure 1:
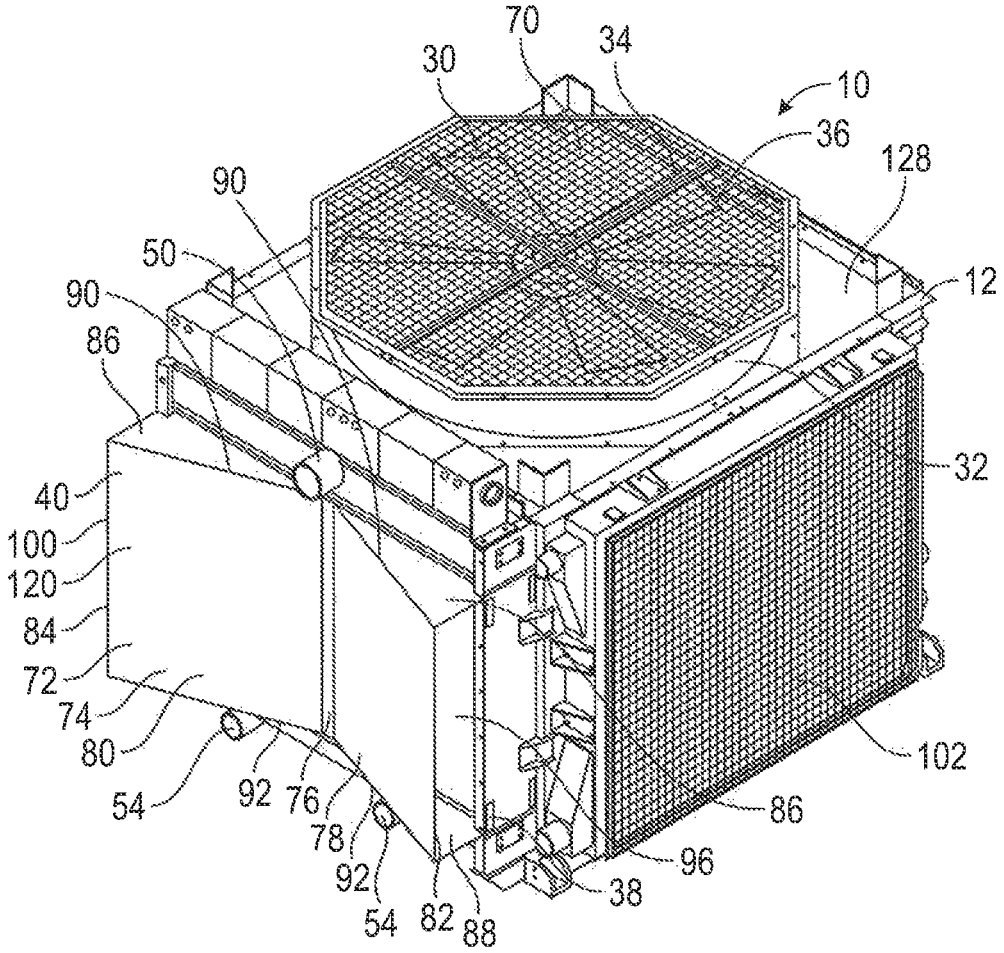
FIG. 1 is a perspective view of a heat exchanger assembly in accordance with a first embodiment of the present invention.
Figure 2:
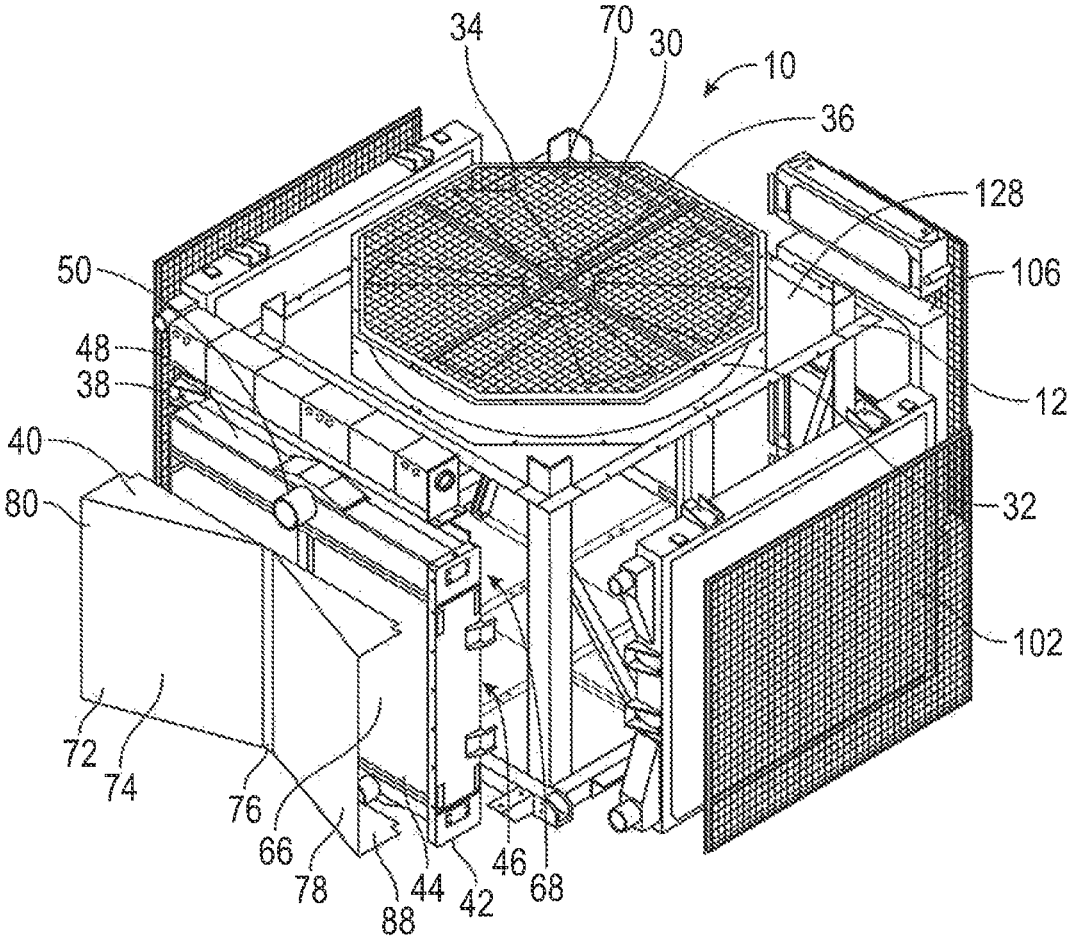
FIG. 2 is a partially exploded perspective view of the heat exchanger assembly shown in FIG. 1, showing a front side of the assembly.
Figure 3:
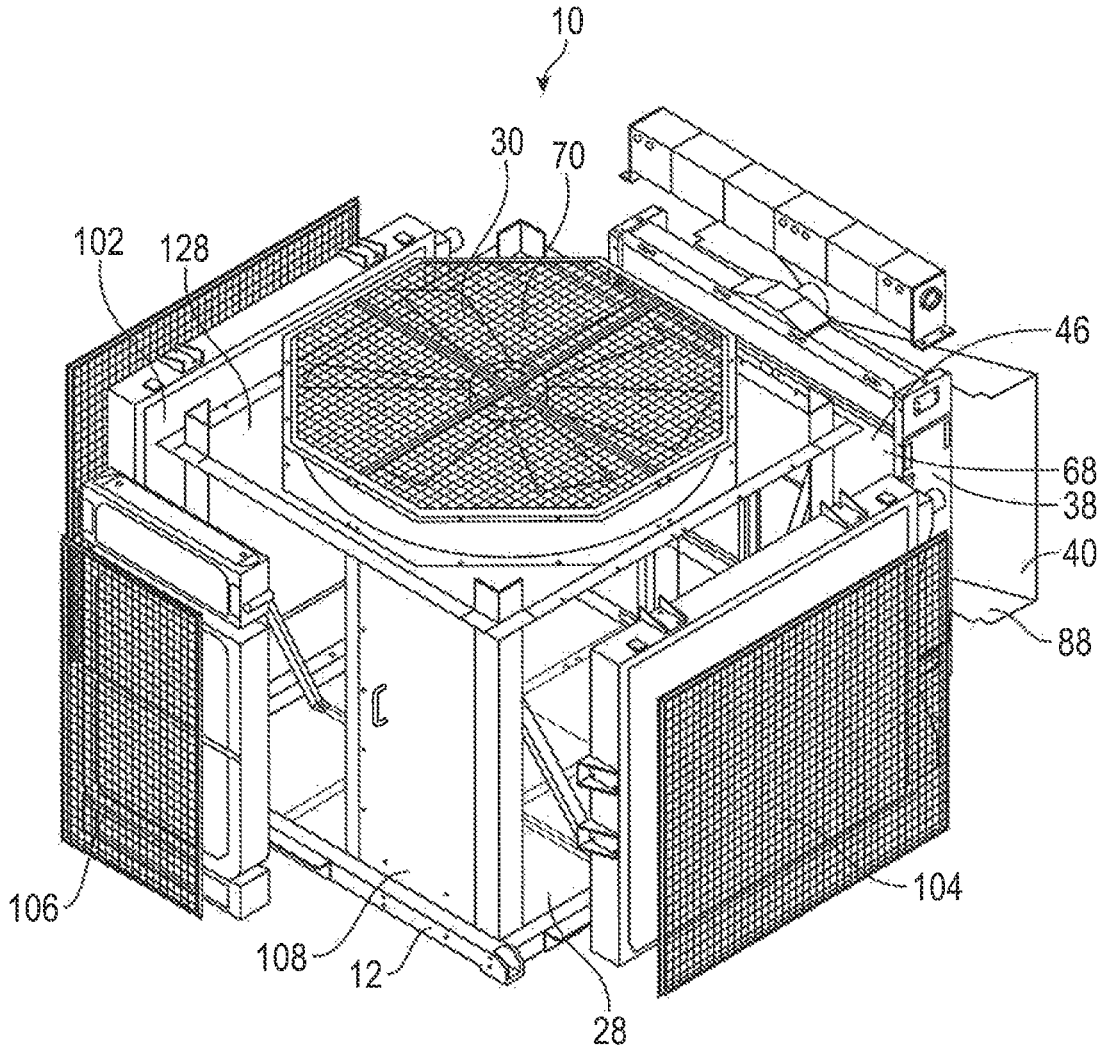
FIG. 3 is a partially exploded perspective view of the heat exchanger assembly shown in FIG. 1, showing a rear side of the assembly.
Figure 4:
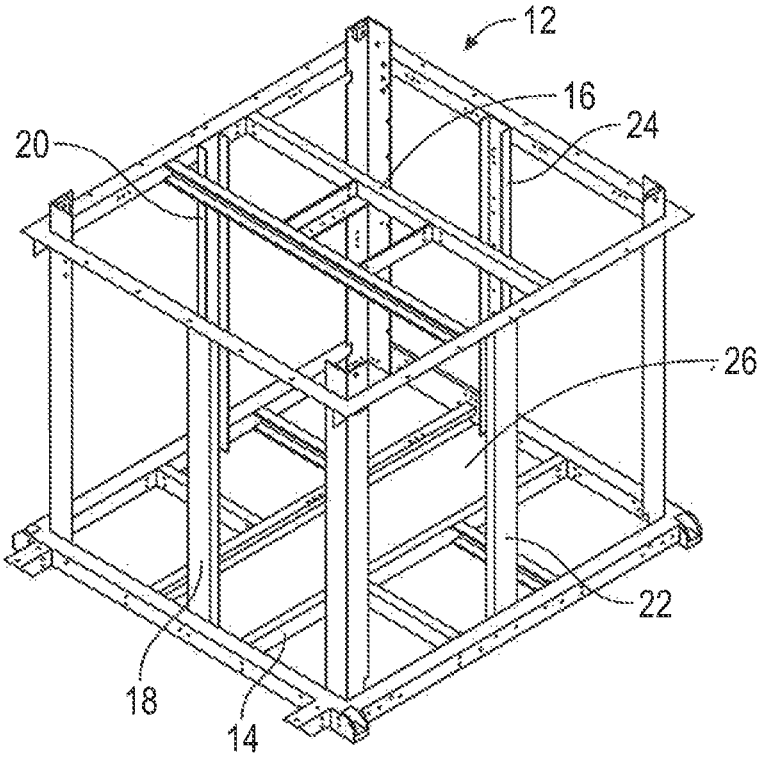
FIG. 4 is a perspective view of a frame of the heat exchanger assembly shown in FIG. 1.

FIGS. 1 to 3 show a heat exchanger assembly 10 in accordance with a first embodiment of the invention. The heat exchanger assembly 10 has a cube-shaped metallic frame 12, as best seen in FIG. 4. The frame 12 has a bottom side 14, a top side 16, a front side 18, a left side 20, a right side 22, and a rear side 24, which together define a hollow internal air flow chamber 26. Each side 14, 16, 18, 20, 22, 24 of the frame 12 is formed from a set of metallic bars, which are spaced so that air can flow into and out of the internal chamber 26 through the openings defined between the bars.

Figure 5:
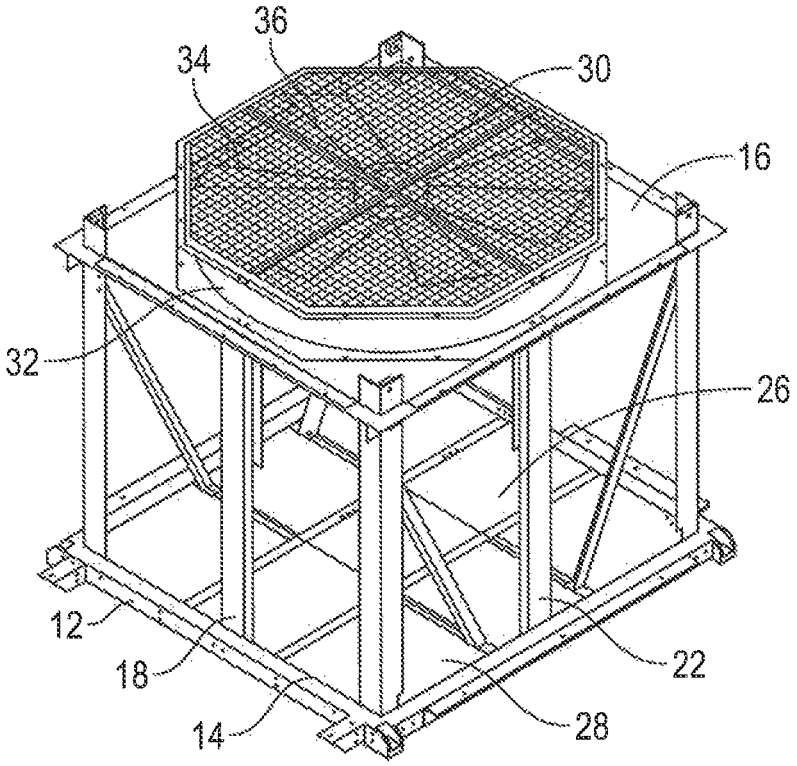
FIG. 5 is a perspective view of the frame shown in FIG. 4, with a top panel and a bottom panel attached to the frame.

When the heat exchanger assembly 10 is assembled, additional components are removably attached to each side 14, 16, 18, 20, 22, 24 of the frame 12. As best shown in FIG. 5, a bottom panel 28 is removably secured to the bottom side 14. The bottom panel 28 is formed from a metallic sheet that substantially covers the bottom side 14. The bottom panel 28 may be secured to the frame 12 using any suitable fastening mechanism, such as screws or bolts. When secured in place, the bottom panel 28 substantially prevents air from passing through the bottom side 14 of the frame 12.

A top panel 128 is removably secured to the top side 16 of the frame 12. The top side 16 carries an air circulation device 70 in the form of a hydraulic fan 30. The fan 30 faces upwardly and has a metallic fan ring 32 that is open to the internal chamber 26, and a set of fan blades 34 that are rotatably mounted within the ring 32. The rotation of the blades 34 is driven by a hydraulic motor, not shown. A safety grate 36 is positioned above the ring 32 to prevent workers and objects from contacting the blades 34 while in operation.

A first heat exchanger 38 and an air intake duct 40 are removably secured to the front side 18 of the frame 12. The first heat exchanger 38 has a generally rectangular body 42 with an outwardly facing side 44 and an inwardly facing side 46. When mounted to the frame 12, the outwardly facing side 44 faces away from the frame 12 and the inwardly facing side 46 faces towards the frame 12. The heat exchanger body 42 has a similar structure to that disclosed in U.S. Pat. No. 5,538,079 to Pawlick, issued Jul. 23, 1996, which is incorporated herein by reference.

Figure 13:
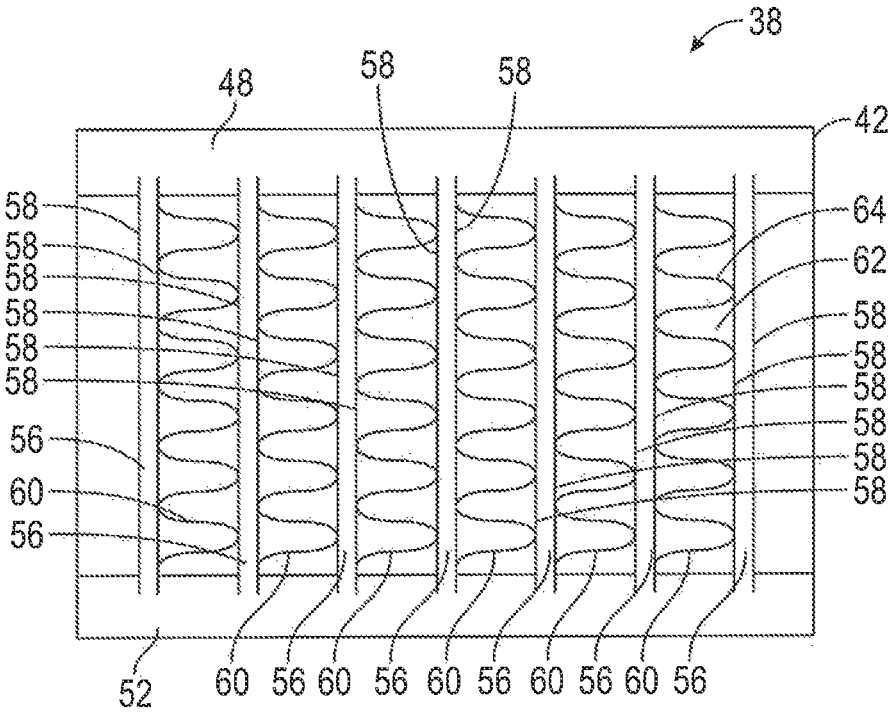
FIG. 13 is a frontal cross-sectional view of a heat exchanger from the heat exchanger assembly shown in FIG. 1.

The internal structure of the heat exchanger body 42 is shown schematically in FIG. 13. The top of the heat exchanger body 42 defines a fluid intake tank 48 that is in fluid communication with a fluid inlet 50, and the bottom of the heat exchanger body 42 defines a fluid return tank 52 that is in fluid communication with a pair of fluid outlets 54. The fluid inlet 50 and the fluid outlets 54 are best seen in FIG. 1.

A set of tubes 56 extend vertically between the fluid intake tank 48 and the fluid return tank 52, and place the fluid intake tank 48 and the fluid return tank 52 in fluid communication. Each tube 56 has an outer wall 58 that is spaced from the outer wall 58 of an adjacent tube 56. A wave-shaped cooling fin 60 extends between each pair of adjacent tubes 56, and contacts the outer walls 58 of the tubes 56. A plurality of air channels 62 are defined between the cooling fins 60 and the outer walls 58 of the tubes 56. The air channels 62 extend from the outwardly facing side 44 of the heat exchanger 38 to the inwardly facing side 46. The cooling fins 60 and the outer walls 58 of the tubes 56 serve as a heat exchange surface 64 for transferring heat from a fluid passing though the tubes 56 to air circulating through the air channels 62. The outwardly facing side 44 of the heat exchanger 38 serves as an air inlet 66 for receiving the air, and the inwardly facing side 46 serves as an air outlet 68 for discharging the air.

The air intake duct 40 is removably secured to the outwardly facing side 44 of the heat exchanger 38. The air intake duct 40 has a duct body 72 that may be formed, for example, from sheet metal. The duct body 72 has a forwardly facing duct wall 74 that substantially covers the outwardly facing side 44 of the heat exchanger 38. The duct wall 74 has a central portion 76 that abuts the outwardly facing side 44 of the heat exchanger 38, a first segment 78 that extends laterally from the central portion 76 towards the right side 22 of the assembly 10, and a second segment 80 that extends laterally from the central portion 76 towards the left side 20 of the assembly 10.

The first segment 78 of the duct wall 74 extends from the central portion 76 to a first duct edge 82 that is spaced forwardly from the outwardly facing side 44 of the heat exchanger 44. The first segment 78 is angled outwardly from the outwardly facing side 44 as it extends from the central portion 76 to the first duct edge 82. The second segment 80 likewise extends from the central portion 76 to a second duct edge 84 that is spaced forwardly from the outwardly facing side 44 of the heat exchanger 44, and is angled outwardly from the outwardly facing side 44 as it extends from the central portion 76 to the second duct edge 84. The angled orientation of the first segment 78 and the second segment 80 provides improved flow characteristics of air passing through the air inlet duct 40 into the air inlet 66 of the heat exchanger 38.

The duct body 72 also has two top walls 86 and two bottom walls 88. Each top wall 86 extends perpendicularly from a respective top edge 90 of the first segment 78 or the second segment 80, and each bottom wall 88 extends perpendicularly from a respective bottom edge 92 of the first segment 78 or the second segment 80. The top walls 86 and the bottom walls 88 are generally triangular in shape, and extend from the duct wall 74 towards the heat exchanger 38. The top walls 86 prevent air from entering the air intake duct 40 directly from above, and the bottom walls 88 prevent air from entering the air intake duct 40 directly from below.

The first segment 78 of the duct wall 74, together with the respective top and bottom walls 86, 88 that extend from the first segment 78, define a first internal air passageway 94 that is in fluid communication with the air inlet 66 of the heat exchanger 38. The first air passageway 94 is open to the atmospheric air via a first inlet opening or intake opening 96 that is defined by the first duct edge 82 and the respective top and bottom walls 86, 88 that extend from the first segment 78. The first air passageway 94 extends from the first inlet opening 96 to the air inlet 66, and provides a path for atmospheric air to enter the air inlet 66. The first inlet opening 96 is angled about 90 degrees from the air inlet 66 of the heat exchanger 38, and opens laterally of the air inlet 66 for drawing air from the right side 22 of the assembly 10.

The second segment 80 of the duct wall 74, together with the respective top and bottom walls 86, 88 that extend from the second segment 80, likewise define a second internal air passageway 98 that is in fluid communication with the air inlet 66. The second air passageway 98 is open to the atmospheric air via a second inlet opening 100 that is defined by the second duct edge 84 and the respective top and bottom walls 86, 88 that extend from the second segment 80. The second inlet opening 100 is angled about 90 degrees from the air inlet 66, and about 180 degrees from the first inlet opening 96, for drawing air laterally from the left side 20 of the assembly 10.

A second heat exchanger 102 and a third heat exchanger 104 are removably secured to the right side 22 and the left side 20 of the frame 12, respectively. The second heat exchanger 102 and the third heat exchanger 104 are substantially identical to the first heat exchanger 38, with the exception that the fluid inlets 50 and the fluid outlets 54 are positioned on lateral sides of the second and third heat exchangers 102, 104 rather than on their outwardly facing sides 44.

A fourth heat exchanger 106 is removably secured to the rear side 24 of the frame 12. The fourth heat exchanger 106 is substantially identical to the second and third heat exchangers 102, 104, with the exception that the body 42 of the fourth heat exchanger 106 is narrower and does not to cover the entire rear side 24 of the frame 12. A service door 108 is attached to the rear side 24 of the frame 12 beside the fourth heat exchanger 106. The service door 108 provides access to the internal chamber 26 of the assembly 10, so that service personnel can inspect and repair the assembly 10 when needed.

Figure 6:
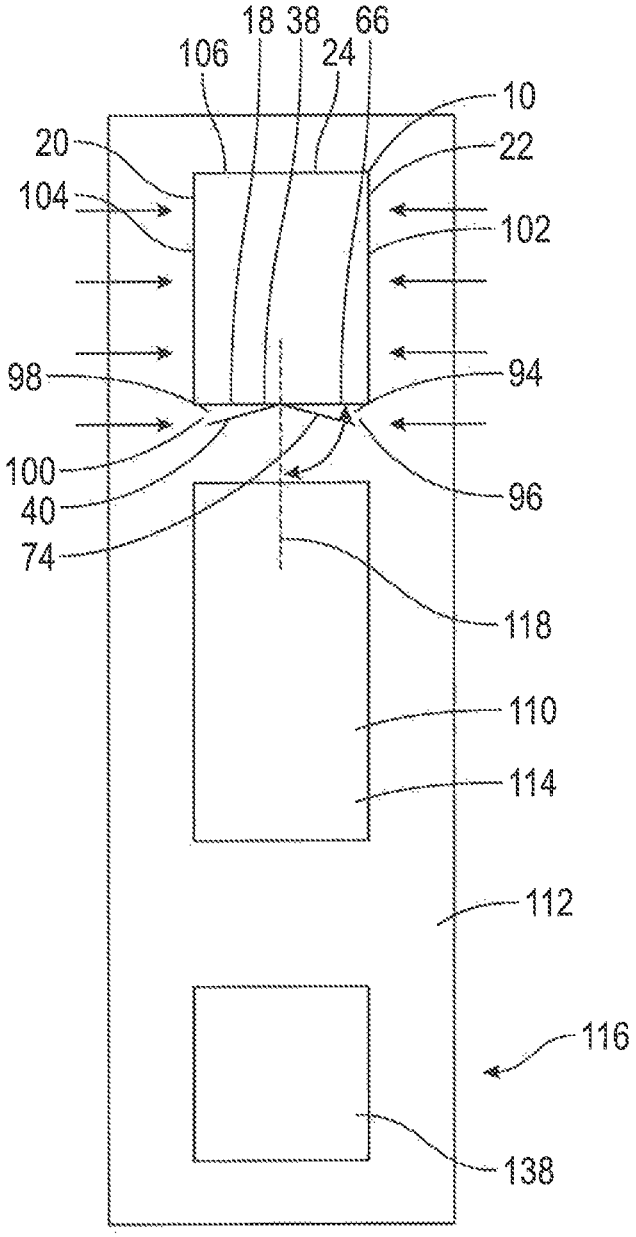
FIG. 6 is a schematic plan view of a mobile trailer carrying an engine and the heat exchanger assembly shown in FIG. 1.

As shown schematically in FIG. 6, the heat exchanger assembly 10 is mounted adjacent to a heat producing device 114 on a mobile trailer 112. The heat producing device 114 is an internal combustion engine 110 that drives one or more pumps 138, schematically shown as mounted on the mobile trailer 112 adjacent the internal combustion engine 110. The trailer 112, together with the components mounted thereto, form a mobile pump unit 116 that can be transported to different locations for hydraulic fracturing. The mobile pump unit 116 is similar to the units described in U.S. Pat. No. 9,109,594 to Pawlick, issued Aug. 18, 2015, and U.S. Pat. No. 9,335,098 to Pawlick, issued May 10, 2016, which are incorporated herein by reference.

The bottom side 14 of the assembly 10 can be mounted to the trailer 112 using any suitable attachment means, such as bolts or screws. The assembly 10 is oriented on the trailer 112 with the first heat exchanger 38 facing towards the engine 110. In the embodiment shown, the first heat exchanger 38 squarely faces the engine 110, with the outwardly facing side 44 of the heat exchanger 38 being angled about 90 degrees relative to a line 118 that extends from the heat exchanger 38 to the engine 110. In other embodiments, the outwardly facing side 44 of the heat exchanger 38 may be angled more than 0 degrees and less than 180 degrees relative to the line; more than 30 degrees and less than 150 degrees; more than 45 degrees and less than 135 degrees; or more than 60 degrees and less than 120 degrees. The second heat exchanger 102 and the third heat exchanger 104 face laterally away from the engine 110, and the fourth heat exchanger 106 faces rearwardly away from the engine 110.

The operation of the heat exchanger assembly 10 will now be described with reference to FIGS. 1 to 6 and 13. The heat exchanger assembly 10 is configured to cool one or more fluids for the engine 110. For example, the assembly 10 may be used to cool compressed air for a turbocharger, transmission oil, diesel fuel, or a liquid coolant. The assembly 10 may also be used to cool fluids for additional heat generating components of the mobile pump unit 116, such as the pumps 138. In some embodiments, the assembly 10 may be used to cool transmission oil, hydraulic circuit oil, and/or gear lube oil from the pumps 138, for example. Each of the four heat exchangers 38, 102, 104, 106 may be used to cool a different fluid, or one or more of the exchangers 38, 102, 104, 106 may be used to cool the same fluid.

During operation, each heat exchanger 38, 102, 104, 106 receives a fluid to be cooled. The fluid is received from the engine 110 or from another fluid supply device, such as an air compressor. The fluid is delivered to the fluid inlet 50, and then circulates through the fluid intake tank 48, the tubes 56, and the fluid return tank 52, before being delivered to the engine 110 or to another heat generating component via the fluid outlets 54. As the fluid passes through the tubes 56, heat is transferred from the fluid to the atmospheric air through the heat exchange surface 64.

As the fluid circulates through the tubes 56, the atmospheric air is simultaneously circulated past the heat exchange surface 64 through the air channels 62. During operation, the fan 30 is configured to draw air from the internal chamber 26 and expel the air upwardly. This creates a vacuum pressure within the internal chamber 26, which draws atmospheric air into the internal chamber 26 through the heat exchangers 38, 102, 104, 106. As the atmospheric air passes through the air channels 62, heat from the fluid is transferred to the air. The heated air is then expelled upwardly by the fan 30, and rises away from the assembly 10 due to its high temperature relative to the surrounding air.

The engine 110 is used to drive the one or more pumps 138 for various pressure pumping applications. For example, the pumps 138 may be frac pumpers, fluid pumpers, cementers, and/or mud pumps. The engine 110 typically produces a large amount of heat while in operation, often significantly raising the temperature of the air immediately surrounding the engine 110. The air intake duct 40 prevents the heat exchanger assembly 10 from drawing in this heated air, which would otherwise significantly reduce its cooling capacity. As shown in FIG. 6, the duct wall 74 of the air intake duct 40 is interposed between the engine 110 and the air inlet 66 of the first heat exchanger 38, and the first and second inlet openings 96, 100 face laterally away from the engine 110. The duct wall 74 is also interposed between the engine 110 and the first and second air passageways 94, 98. This prevents the heated air from being drawn directly into the air inlet 66. Instead, the orientation of the first and second inlet openings 96, 100 draws the atmospheric air into the air inlet 66 laterally from the right and left sides 20, 22 of the assembly 10, respectively. Because this air has a lower temperature than the air surrounding the engine 110, the cooling capacity of the first heat exchanger 38 is improved. The flow of air into the assembly 10 is shown with arrows in FIG. 6.

In contrast, if the air intake duct 40 is removed, then the hot air surrounding the engine 110 is drawn directly into the air inlet 66 of the first heat exchanger 38, resulting in a significantly diminished cooling capacity. As each of the second, third, and fourth heat exchangers 102, 104, 106 are orientated to face away from the engine 110, no additional air intake ducts 40 are required to prevent the hot air surrounding the engine 110 from being drawn into these heat exchangers 102, 104, 106.

The air intake duct 40 optionally incorporates a heat shielding surface 120 that is configured to prevent the air passing through the first air passageway 94 and the second air passageway 98 from being heated by the engine 110. For example, the duct wall 74 may optionally incorporate cladding that inhibits the transfer of heat from the engine 110 to the air passageways 94, 98 by conduction, by convection, and/or by thermal radiation. The heat shielding surface 120 can help to improve the cooling capacity of the assembly 10 by maintaining the air at a lower temperature as it enters the air inlet 66 of the heat exchanger 38. Any suitable form of thermal insulation could be selected based on the operating conditions and the required cooling capacity of the assembly 10.

The air intake duct 40 is preferably removable from the heat exchanger assembly 10, to facilitate cleaning and repair. Optionally, the air intake duct 40 is also adjustable. For example, in some preferred embodiments the air intake duct 40 can swing inwards towards the outwardly facing side 44 of the heat exchanger 38 to provide greater access to the front of the engine 110 for servicing and/or for air flow control in cold weather.

Reference is now made to FIGS. 7 to 11, which show a heat exchanger assembly 10 in accordance with a second embodiment of the invention. The assembly 10 is identical to that shown in FIG. 1, but with a narrower construction that is adapted for a side-by-side mounting configuration. Like numerals are used to denote like components.

Figure 10:
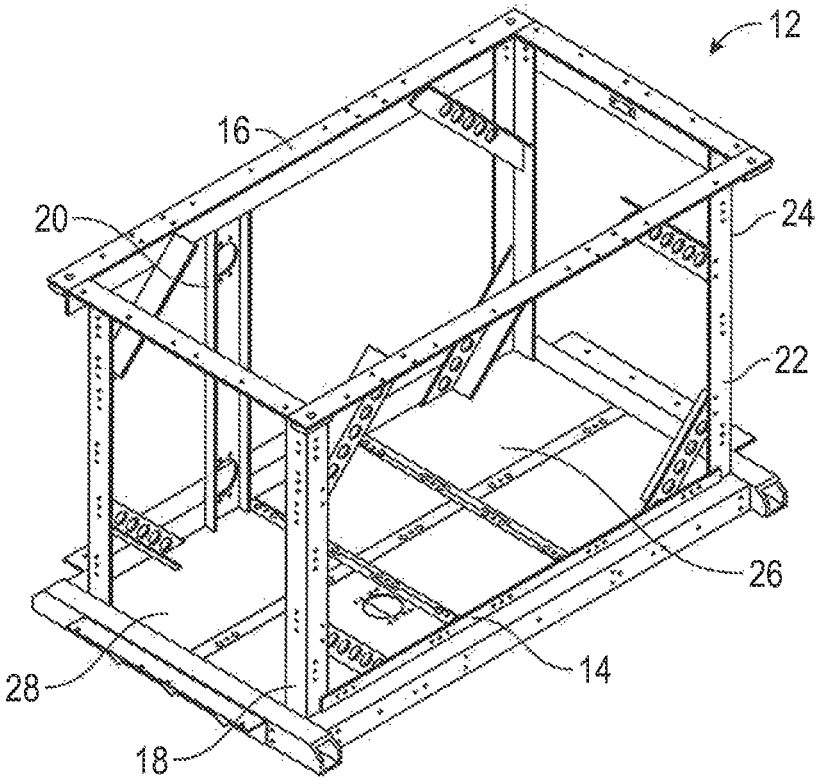
FIG. 10 is a perspective view of a frame of the heat exchanger assembly shown in FIG. 7.
Figure 11:
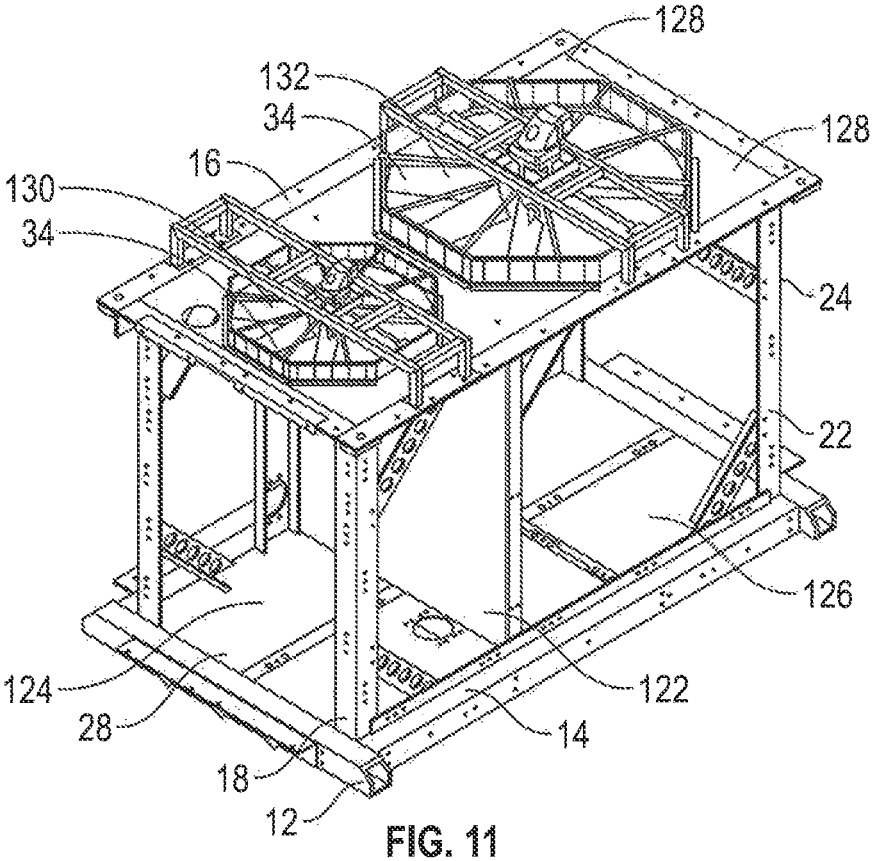
FIG. 11 is a perspective view of the frame shown in FIG. 10, with a top panel, a bottom panel, and an internal panel attached to the frame.

As shown in FIG. 10, the heat exchanger assembly 10 has a rectangular frame 12 that defines a hollow internal chamber 26. When assembled, an internal panel 122 is positioned inside the frame 12, dividing the internal chamber 26 into a front chamber 124 and a rear chamber 126, as shown in FIG. 11. A top panel 128 is removably secured to the top side 16 of the frame 12. The top panel 128 carries a front fan 130 that is positioned above the front chamber 124, and a rear fan 132 that is positioned above the rear chamber 126. The front fan 130 and the rear fan 132 are operable to create an upwards flow of air from the front chamber 124 and the rear chamber 126, respectively.

Figure 7:
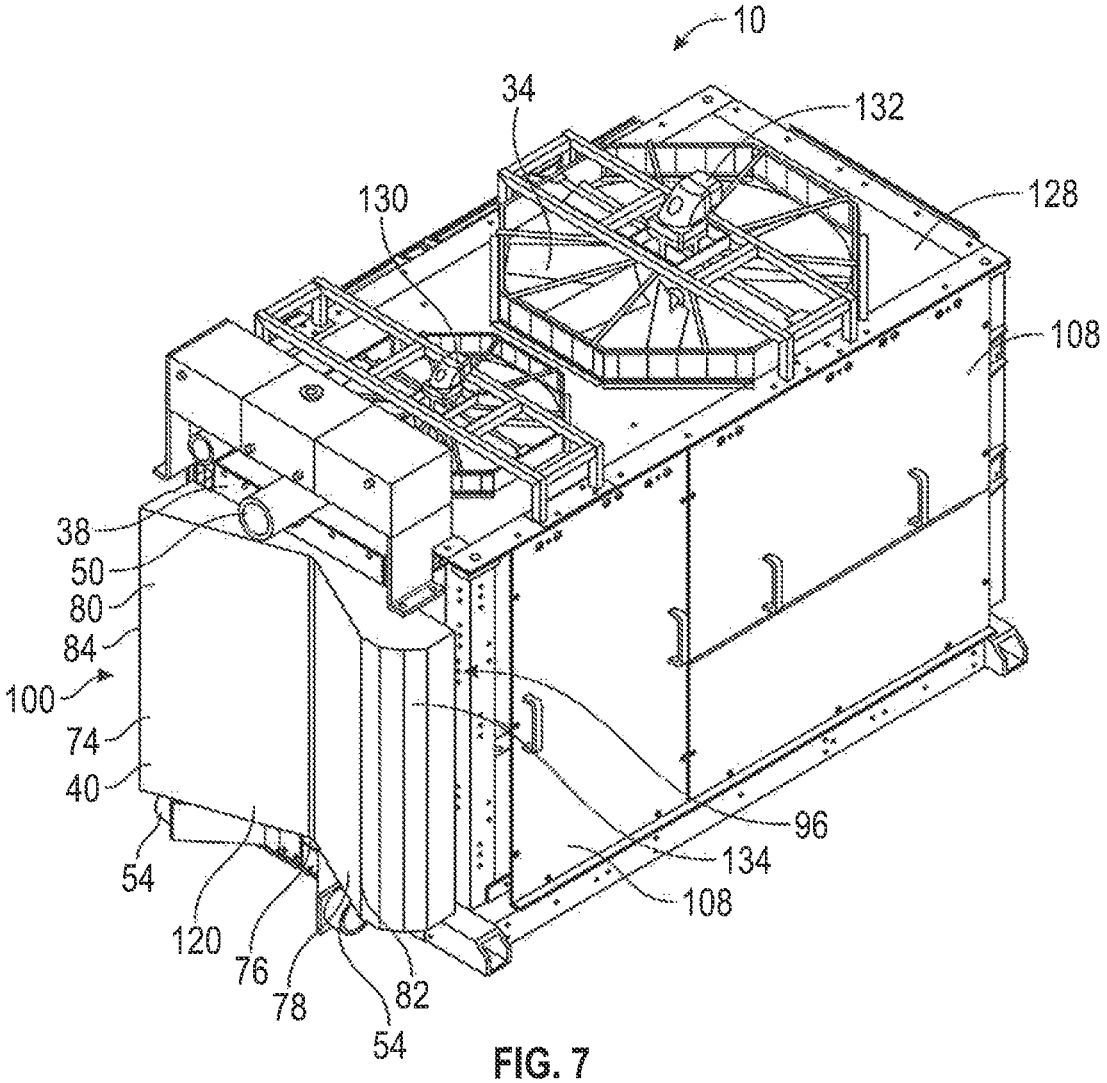
FIG. 7 is a perspective view of a heat exchanger assembly in accordance with a second embodiment of the present invention.

As in the previous embodiment, a first heat exchanger 38 is removably secured to the front side 18 of the frame 12, as shown in FIG. 7. The first heat exchanger 38 is identical to the one shown in FIG. 1, with the exception that the heat exchanger 38 is narrower so as to fit over the narrower front side 18 of the frame 12. An air intake duct 40 is removably secured to the outwardly facing side 44 of the first heat exchanger 38.

The air intake duct 40 is identical to the one shown in FIG. 1, with the notable exception that a curved side wall 134 extends from the first duct edge 82 of the duct wall 74. The side wall 134 extends laterally past the heat exchanger 38, and is curved so as to angle the first inlet opening 96 rearwardly relative to the air inlet 66. In the embodiment shown, the first inlet opening 96 is angled about 180 degrees relative to the air inlet 66 of the heat exchanger 38. In other embodiments, the first inlet opening 96 could be angled more than 90 degrees relative to the air inlet 66, or more than 135 degrees relative to the air inlet 66, for example.

Figure 8:
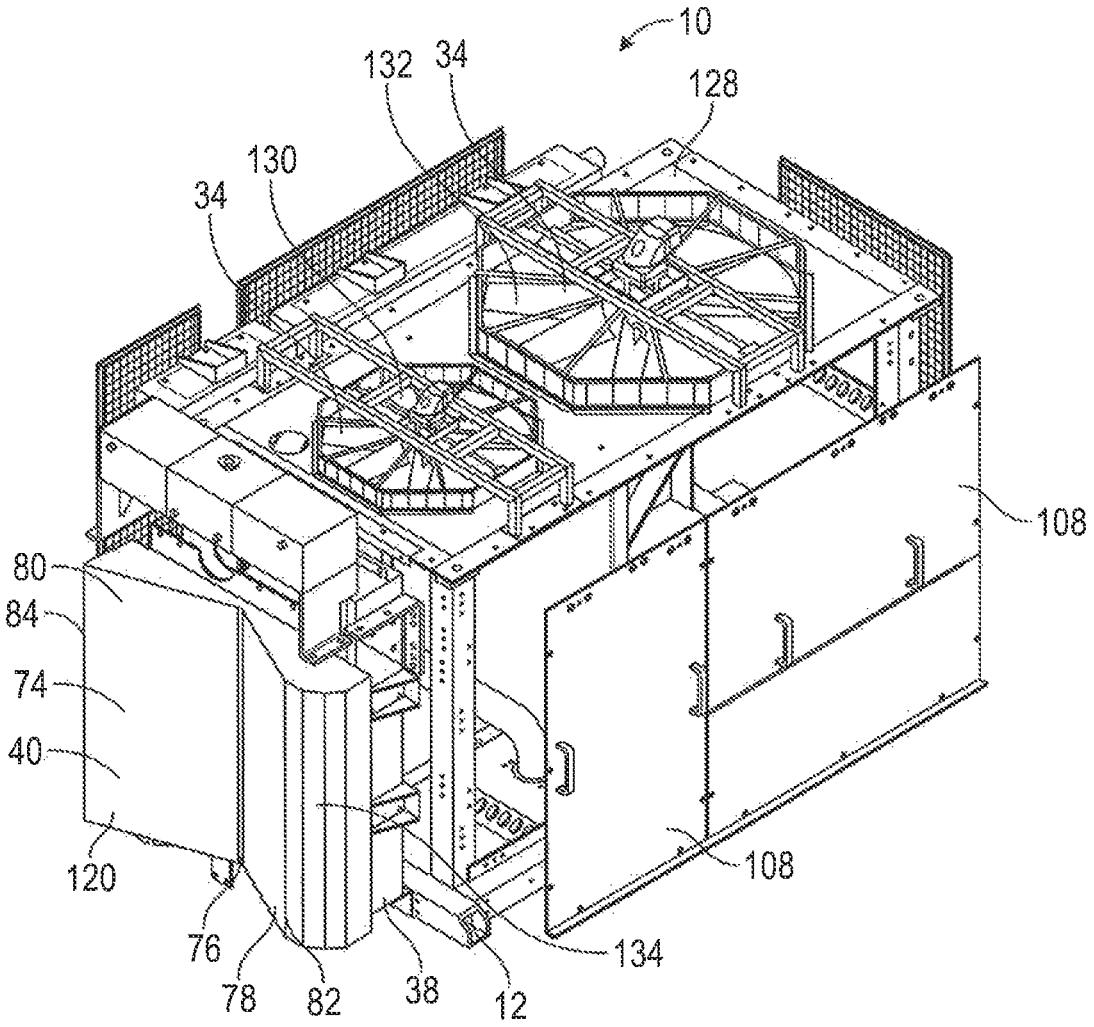
FIG. 8 is a partially exploded perspective view of the heat exchanger assembly shown in FIG. 7, showing a front side of the assembly.
Figure 9:
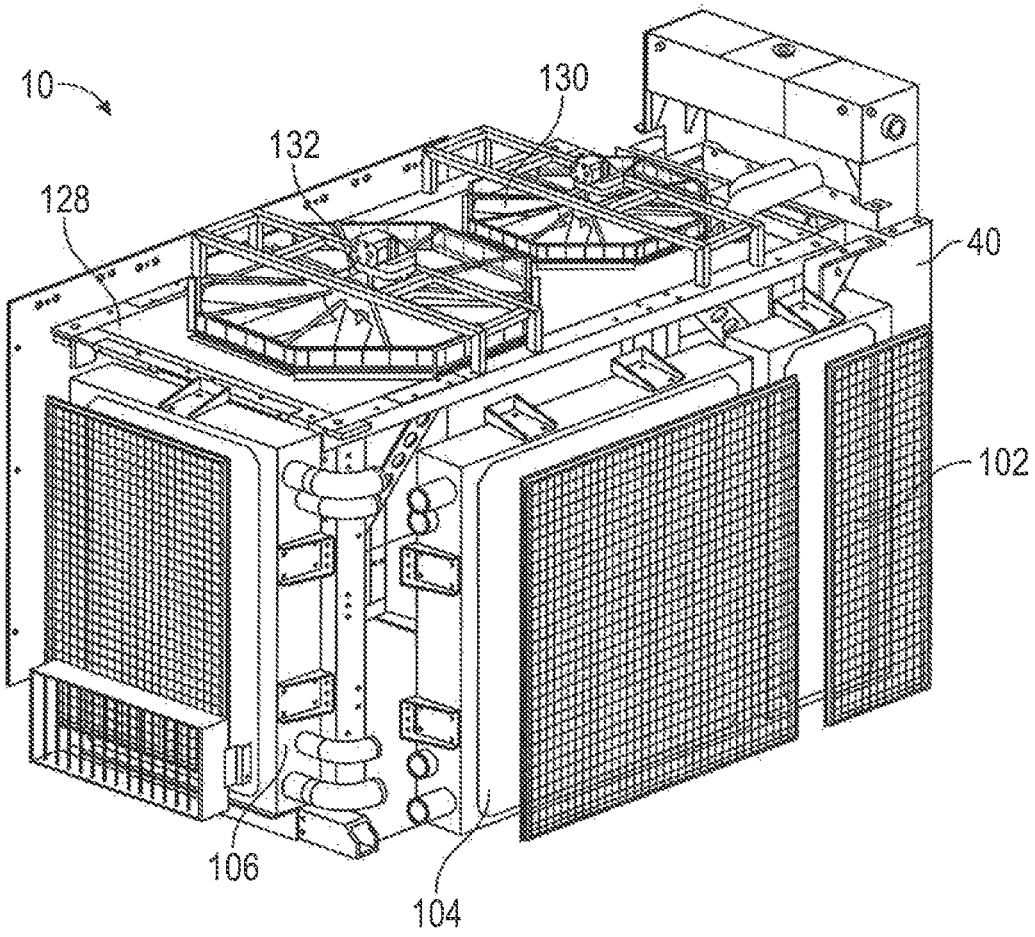
FIG. 9 is a partially exploded perspective view of the heat exchanger assembly shown in FIG. 7, showing a rear side of the assembly.

In the embodiment shown in FIGS. 7 to 9, the second heat exchanger 102 and the third heat exchanger 104 are positioned on the left side 20 of the frame 12, and the fourth heat exchanger 106 is positioned on the rear side 22 of the frame 12. The second, third, and fourth heat exchangers 102, 104, 106 are identical to those shown in FIG. 1, with the notable exception that the size and configuration of the heat exchangers 102, 104, 106 has been adapted for the narrower frame 12. A number of service doors 108 are provided on the right side 22 of the frame 12.

Figure 12:
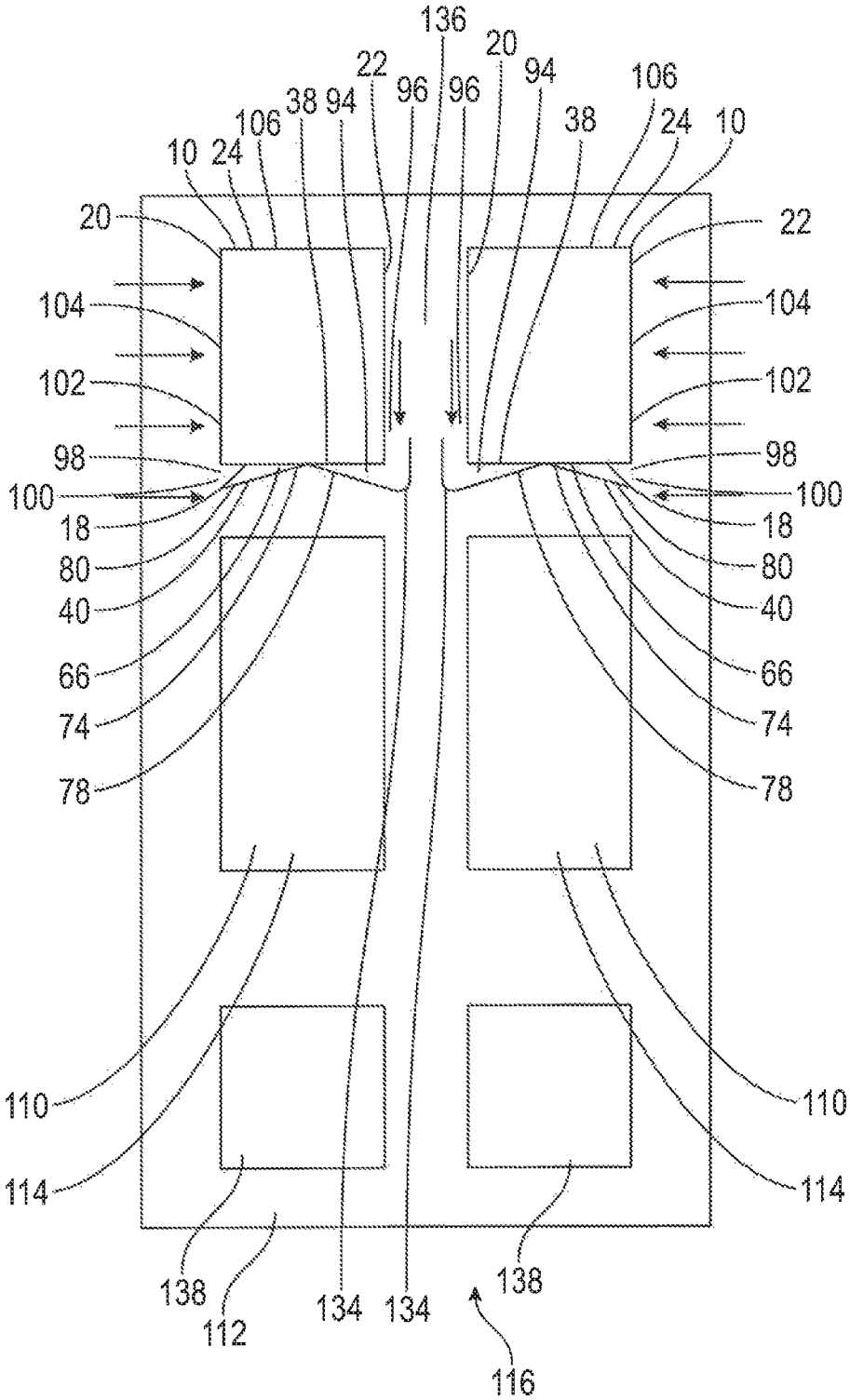
FIG. 12 is a schematic plan view of a mobile trailer carrying two engines, the heat exchanger assembly shown in FIG. 7, and a second heat exchanger assembly that is the mirror image of the heat exchanger assembly shown in FIG. 7.

The heat exchanger assembly 10 is adapted for mounting to a mobile trailer 112 in a side-by-side configuration, as shown schematically in FIG. 12. The heat exchanger assembly 10 shown in FIG. 7 is mounted to the left side of the mobile trailer 112, and a second heat exchanger assembly 10, which is the mirror image of the first heat exchanger assembly 10, is mounted on the right side of the mobile trailer 112. The two heat exchanger assemblies 10 are spaced from one another, with a walkway 136 therebetween. Two engines 110 are also mounted to the mobile trailer 112 in front of the two heat exchanger assemblies 10. The two side-by-side engines 110 are used to drive pumps 138, which may, for example, be twin pumpers and/or twin cementers.

Having two engines 110 and two heat exchanger assemblies 10 mounted to a single mobile trailer 112 provides for redundancy in the event that one of the engines 110 and/or one of the heat exchanger assemblies 10 fails. For example, if one of the engines 110 fails, it may be possible to continue operating the pumps 138 or other equipment using the remaining engine 110. In this way, the interruption of the pumping process at a crucial stage of the process can be avoided.

As in the first embodiment, during operation of the heat exchanger assemblies 10, each of the heat exchangers 38, 102, 104, 106 receives a fluid to be cooled. The fluid passes through the heat exchangers 38, 102, 104, 106 in exactly the same manner as in the first embodiment, and the cooled fluid is delivered to one of the two engines 110, or to another heat generating component. Atmospheric air is drawn through the heat exchangers 38, 102, 104, 106 by rotating the blades 34 of the front fan 130 and the rear fan 132. The front fan 130 draws air out of the front chamber 124, which creates a vacuum pressure that draws atmospheric air through the first heat exchanger 38 and the second heat exchanger 102. The rear fan 132 draws air out of the rear chamber 126, which creates a vacuum pressure that draws atmospheric air through the third heat exchanger 104 and the fourth heat exchanger 106. The front fan 130 and the rear fan 132 may be operated independently.

Referring to the heat exchanger assembly 10 mounted on the left side of the mobile trailer 112, air is drawn into the second inlet opening 100 of the air intake duct 40 laterally from the left side 20 of the assembly 10. Because of the curved side wall 134 and the rearwardly angled first inlet opening 96, air is drawn into the first inlet opening 96 from the walkway 136, rearwardly of the first heat exchanger 38. The rearwardly angled side wall 134 prevents the first inlet opening 96 from drawing air from forwardly of the heat exchanger assembly 10. The air intake duct 40 of the heat exchanger assembly 10 mounted on the right side of the mobile trailer 112 likewise draws air from the right side 22 of the assembly 10 and from the walkway 136, rearwardly of the first heat exchanger 38.

This configuration of the air intake ducts 40 prevents the side-by-side assemblies 10 from drawing in hot air from the engine 110 that is positioned directly in front of the first heat exchanger 38, as in the first embodiment shown in FIG. 6. Furthermore, because the side wall 134 is interposed between the first inlet opening 96 and the engine 110 that is positioned diagonally in front of the first heat exchanger 38, the air intake duct 40 also prevents the assemblies 10 from drawing in hot air from the diagonally positioned engine 110 as well. In contrast, if the air intake ducts 40 from the first embodiment of the invention were used, the hot air from the diagonally positioned engine 110 could be drawn into the first inlet opening 96. Adapting the air intake ducts 40 to incorporate the curved side walls 134 and the rearwardly angled first inlet openings 96 thus helps to draw cooler air into the heat exchanger assemblies 10 when mounted in a side-by-side configuration, and thereby improves the cooling capacity of the assemblies 10.

Although two exemplary embodiments of the invention have been illustrated and described, the invention is not limited to these specific embodiments. For example, the heat exchanger assemblies 10 may incorporate additional heat exchangers 38, 102, 104, 106 or fewer heat exchangers 38, 102, 104, 106, depending on the available space and the cooling capacity that is needed. The assemblies 10 may also have different proportions and shapes from those shown in the drawings.

Other types of heat exchangers 38, 102, 104, 106 could also be used in place of the ones illustrated and described herein. For example, heat exchangers 38, 102, 104, 106 that use a different kind of heat exchange surface 64, such as a perforated metal plate, could be used in place of the exemplary constructions that have been described. The tubes 56 could also run horizontally instead of vertically.

The assemblies 10 could also be adapted for different purposes than those described herein. For example, instead of cooling fluids for an internal combustion engine 110 that drives a hydraulic fracturing pump, the assemblies 10 could instead be used to cool different kinds of heat producing devices 114, such as an electric motor or a motor that drives a drill or a mixer. The assemblies 10 need not be mounted to a mobile trailer 112, and could instead be placed at any suitable location where heat exchange is required.

The invention is not in any way limited to the specific construction of the air intake duct 40 that has been illustrated and described. Rather, any suitable construction that prevents hot air that is produced by a heat producing device 114 from being drawn into the air inlet 66 of a heat exchanger 38 that faces the heat producing device 114 could be used. In some embodiments, the air intake duct 40 could have a single inlet opening 96 and a single air passageway 94, instead of the dual construction that is shown in the drawings. Nor is the invention limited to the specific fan 30 and frame 12 constructions that have been described and illustrated.

The various components of the assemblies 10, including the heat exchangers 38, 102, 104, 106 and the air intake ducts 40, may be secured to the frame 12 using any suitable attachment means, such as screws and bolts. Although it is preferred that the components are removable from the frame 12 for service and repair, this is not necessary. In some embodiments, the assembly 10 may not include a frame 12 at all.

The invention includes all methods and uses of the assembly 10, whether explicitly described herein or implicit in the described structures and features. For example, the invention includes a method of cooling a fluid for a heat producing device 114, including providing a heat exchanger 38 having an air inlet 66 that faces the heat producing device 114; providing an air intake duct 40 that directs air into the air inlet 66; positioning the air intake duct 40 relative to the heat exchanger 38 and the heat producing device 114 so that heated air produced by the heat producing device 114 is prevented from entering the air inlet 66; circulating the fluid past a heat exchange surface 64 of the heat exchanger 38; drawing the air into the air inlet 66; and circulating the air past the heat exchange surface 64 so that heat from the fluid is transferred to the air.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

I claim:

1. A mobile pump unit comprising:

a mobile trailer having mounted thereon one or more pumps, an internal combustion engine to power the one or more pumps, and a heat exchanger assembly for cooling a fluid;

the heat exchanger assembly comprising:

a heat exchanger having an air inlet that faces the engine, the heat exchanger comprising:

the air inlet for receiving air;

a fluid inlet for receiving the fluid;

a heat exchange surface for transferring heat from the fluid to the air;

an air outlet for discharging the air; and a fluid outlet for discharging the fluid;

the heat exchanger assembly further comprising:

an air circulation device for moving the air through the heat exchanger; and an air intake duct that directs the air into the air inlet of the heat exchanger, the air intake duct being configured to resist heated air produced by the engine from entering the air inlet;

wherein the air intake duct has an inlet opening that faces away from the engine and opens laterally of the air inlet;

wherein the air intake duct defines an air passageway that extends from the inlet opening to the air inlet;

wherein the air intake duct has a duct wall that is interposed between the air passageway and the engine;

wherein the inlet opening is a first inlet opening that is configured to draw the air laterally from a first side of the heat exchanger assembly, the air intake duct having a second inlet opening that is configured to draw the air laterally from a second side of the heat exchanger assembly;

wherein the duct wall has a first segment and a second segment, the first segment extending from a central portion of the air inlet to the first inlet opening, the second segment extending from the central portion of the air inlet to the second inlet opening;

wherein the first segment is angled outwardly from the air inlet as the first segment extends from the central portion to the first inlet opening; and wherein the second segment is angled outwardly from the air inlet as the second segment extends from the central portion to the second inlet opening.

2. The mobile pump unit according to claim 1, wherein the air intake duct is removable.

3. The mobile pump unit according to claim 1, wherein the air intake duct comprises a heat shielding surface that is configured to prevent the engine from heating the air within the air intake duct.

4. The mobile pump unit according to claim 3, wherein the heat shielding surface is configured to prevent the engine from heating the air within the air intake duct by conduction.

5. The mobile pump unit according to claim 3, wherein the heat shielding surface is configured to prevent the engine from heating the air within the air intake duct by convection.

6. The mobile pump unit according to claim 3, wherein the heat shielding surface is configured to prevent the engine from heating the air within the air intake duct by thermal radiation.

7. The mobile pump unit according to claim 3, wherein the heat shielding surface is configured to prevent the engine from heating the air within the air intake duct by at least one of: conduction, convection, and thermal radiation.

8. The mobile pump unit according to claim 1, wherein the heat exchanger has a rectangular or square body with an outwardly facing side and an inwardly facing side;

wherein the outwardly facing side comprises the air inlet;

wherein the inwardly facing side comprises the air outlet;

wherein the heat exchanger body defines a plurality of air channels that extend from the outwardly facing side to the inwardly facing side and pass through or adjacent to the heat exchange surface;

wherein the air intake duct is interposed between the engine and the outwardly facing side of the heat exchanger body; and wherein the outwardly facing side of the heat exchanger body is angled, relative to a line extending from the heat exchanger body to the engine, more than 0 degrees and less than 180 degrees.

9. The mobile pump unit according to claim 8, wherein the outwardly facing side of the heat exchanger body is angled, relative to the line extending from the heat exchanger body to the engine, more than 60 degrees and less than 120 degrees.

10. The mobile pump unit according to claim 1, further comprising a frame for mounting the heat exchanger, the air circulation device, and the air intake duct, wherein the heat exchanger is removable from the frame.

11. The mobile pump unit according to claim 1, wherein the air circulation device comprises a fan; and wherein the heat exchanger assembly defines an internal air flow chamber that is open to the air outlet, the fan being configured to produce an air flow that draws the air through the heat exchanger and into the internal air flow chamber, and then expels the air upwardly from the heat exchanger assembly.

12. The mobile pump unit according to claim 1, wherein the heat exchanger assembly has a cubic or box shape;

wherein the heat exchanger is a first heat exchanger, the heat exchanger assembly further comprising a second heat exchanger, a third heat exchanger, and a fourth heat exchanger;

wherein the air circulation device is configured to draw air through the second heat exchanger, the third heat exchanger, and the fourth heat exchanger;

wherein the first heat exchanger is positioned on a front side of the heat exchanger assembly that faces the engine;

wherein the second heat exchanger is positioned on a right side of the heat exchanger assembly, which faces laterally away from the engine;

wherein the third heat exchanger is positioned on a rear side of the heat exchanger assembly, which faces rearwardly away from the engine; and wherein the fourth heat exchanger is positioned on a left side of the heat exchanger assembly, which faces laterally away from the engine.

13. The mobile pump unit according to claim 1, wherein the fluid is compressed air, transmission oil, hydraulic oil, gear oil, diesel fuel, or a liquid coolant.

14. The mobile pump unit according to claim 1, wherein the fluid outlet is configured to deliver the fluid to the engine or to another heat generating component.

* * * * *